US006161320A

United States Patent [19]

Peterson

[11] Patent Number: 6,161,320

[45] Date of Patent: Dec. 19, 2000

[54] PORTABLE, MODULAR, GRAPHICS-DISPLAY SYSTEM

[76] Inventor: Steven Charles Peterson, 508 Las Alturas Rd., Santa Barbara, Calif. 93103

[21] Appl. No.: 08/887,102

[22] Filed: Jul. 2, 1997

[51] Int. Cl.[7] ..... G09F 7/00

[52] U.S. Cl. ..... 40/605; 40/603; 160/135; 160/351

[58] Field of Search ..... 40/605, 603, 604, 40/606, 610, 611; 160/135, 351; 403/389, 398, 399

[56] References Cited

U.S. PATENT DOCUMENTS

| | | | |
|---|---|---|---|
| D. 317,469 | 6/1991 | Beaulieu . | |
| 2,895,717 | 7/1959 | De Falco | 160/135 |
| 4,765,495 | 8/1988 | Bisk | 211/113 |
| 4,774,792 | 10/1988 | Ballance | 160/135 X |
| 4,842,035 | 6/1989 | Thompson | 160/351 |
| 5,211,502 | 5/1993 | Upham-Hill | 403/389 X |
| 5,537,766 | 7/1996 | Nickens et al. . | |

*Primary Examiner*—Cassandra H. Davis

[57] ABSTRACT

A portable display system is provided for use by exhibitors at tradeshow and other events that is comprised of a plurality of display stands and display-stand connectors. The individual display stands are comprised of a free-standing frame and a rollable panel that is attached to the frame for viewing. Multiple display stands may be easily connected and arranged relative to each other to create larger displays, for example, a substantially-curved wall or a triangular tower. The exhibitor has the flexibility of using the display stands individually or connected together.

11 Claims, 5 Drawing Sheets

PORTABLE, MODULAR, GRAPHICS-DISPLAY SYSTEM

BACKGROUND—FIELD OF INVENTION

This invention relates to portable, modular, graphics-display systems of the kind typically used by tradeshow exhibitors.

BACKGROUND—DESCRIPTION OF THE PRIOR ART

Portable graphics displays are used extensively by exhibitors at tradeshows to create backdrops at their exhibit areas. The displays are intended to catch the eye of attendees who walk by and to quickly visually communicate the exhibiting company's name, product or service, and other important information. The displays serve to form a polished and professional image of the exhibiting company. Portable graphics displays also are used by businesses for similar purposes at seminars, sales meetings, conventions, and other business gatherings.

It is desirable to the exhibitor that his display system be very portable, easy to use, easy to update graphically, and cost effective. It is also desirable that his display system be highly versatile, that it be capable of being used in a variety of configurations and settings, and that it be modular and easily expanded.

Two of the more widely used displays at tradeshows today are the "pop-up" display wall and the permanently-hinged, foldable, rigid-panel display wall. The "pop-up" display wall consists of a collapsible truss frame that expands to the size of the full wall when erected. Panels are then typically unrolled and attached to the expanded frame. A typical "pop-up" display is shown in U.S. Design Patent No. 317,469 issued to Beaulieu on Jun. 11, 1991. The other current typical display is the permanently-hinged, foldable, rigid-panel display wall. This display is set up by unfolding the packed panels and standing the entire structure up. Such a type of display is described in U.S. Pat. No. 5,537,766 issued to Nickens, et al, on Jul. 23, 1996.

Folding rigid-panel displays tend to be difficult to transport since their carrying cases must be at least as large as the individual rigid panels, and are also typically heavy due to the inherent weight of their rigid panels. Both the "pop up" and the permanently-hinged, folding, rigid-panel display walls are greatly limited in versatility in that they can only be set up as a single, full-size display wall. Further, these displays tend to be expensive, and one must initially invest in an entire display wall.

OBJECTS AND ADVANTAGES

Accordingly, besides the objects and advantages of the portable tradeshow displays described above, several objects and advantages of the present invention are:

(a) to provide a versatile, portable, modular, graphics-display system comprised of a plurality of individual free-standing display stands that can be used individually at a single location, or that can be used individually at different locations. For example, one might use two of the individual display stands on either side of the main entrance to a seminar, and a third stand by the podium where a speaker is presenting. In another situation, one may choose to send one individual stand to one seminar, and another stand to another seminar that is occurring on the same day;

(b) to provide an easy, quick, and convenient method for connecting the individual display stands together consisting of a removable connector that holds the individual display stands adjacent to each other, that further allows the display stands to be angled relative to each other in a variety of configurations, that further allows for the easy removal of the connector when single stands are used as individual free-standing units, and that further requires no tools to install or remove;

(c) to provide a display system comprised of a plurality of free-standing display stands that can be connected together in a variety of configurations such as a substantially-curved wall or a triangular tower, and that when so connected does not require that the individual stands have their support feet attached;

(d) to provide a display system that allows an individual or small business with a limited budget to purchase and use one display stand initially, and then purchase additional stands as his or their budget allows;

(e) to provide a display system that allows an individual or small business to purchase additional display stands to expand his or their exhibiting capabilities as needed; and (f) to provide a display system that allows a single damaged or lost display stand to be easily individually replaced.

Further objects and advantages of my invention will become apparent from a consideration of the drawings and ensuing description.

DRAWING FIGURES

REFERENCE NUMERALS IN DRAWINGS

| | |
|---|---|
| 20 graphic panel | 22 grommet |
| 24 band | 28 peg |
| 30 bottom crossbar | 32 PVC elbow-shaped fitting |
| 34 horizontal PVC pipe | 36 hole (not visible on drawing) |
| 40 middle crossbar | 42 PVC tee-shaped fitting |
| 50 top crossbar | 60 upper vertical PVC-pipe upright |
| 62 lower vertical PVC-pipe upright | 64 threaded hole (not visible on drawing) |
| 70 strut assembly | 72 strut PVC pipe |
| 74 PVC elbow-shaped fitting | 76 cap |
| 78 through hole | 80 foot assembly |

-continued

| | |
|---|---|
| 82 cap | 84 pin |
| S6 connector | 88 aluminum pipe |
| 90 single-piece, snap-on display-frame connector | |
| 92 single-piece, E-shaped, snap-on display-frame connector | |
| 94 multiple-piece, clamping display-frame connector | |
| 96 multiple-piece, internally-hinged, snap-on display-frame connector | |
| 100 clamp bracket | 102 matching clamp bracket |
| 104 threaded through hole | 106 through hole |
| 108 thumbscrew | 110 snap-on bracket |
| 112 matching snap-on bracket | 114 through hole |
| 116 through hole | 118 hinge pin |
| 120 retaining flange head | |

DESCRIPTION

Figure 1:
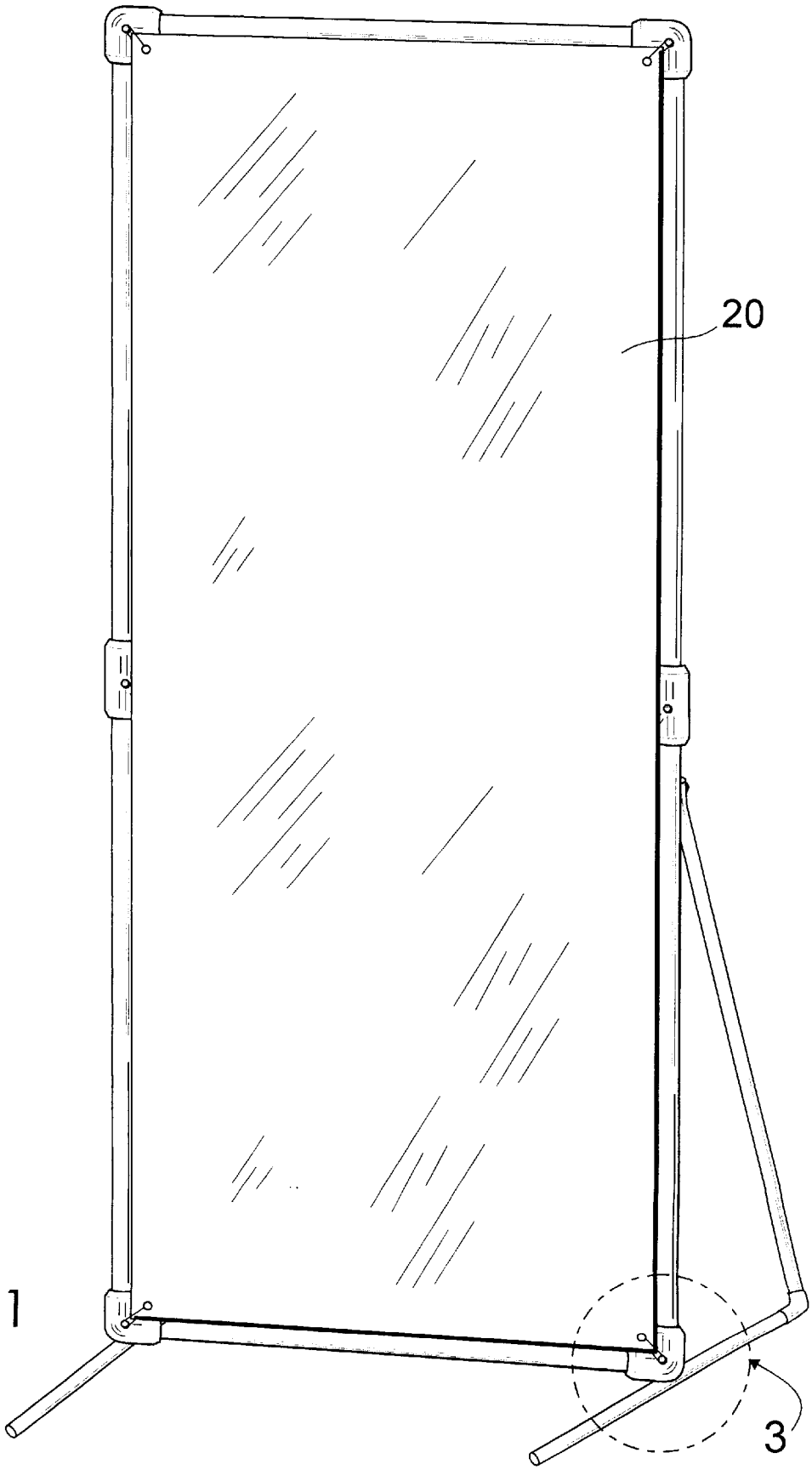
FIG. 1 shows an individual, assembled display-stand frame with a graphic panel attached.
Figure 2:
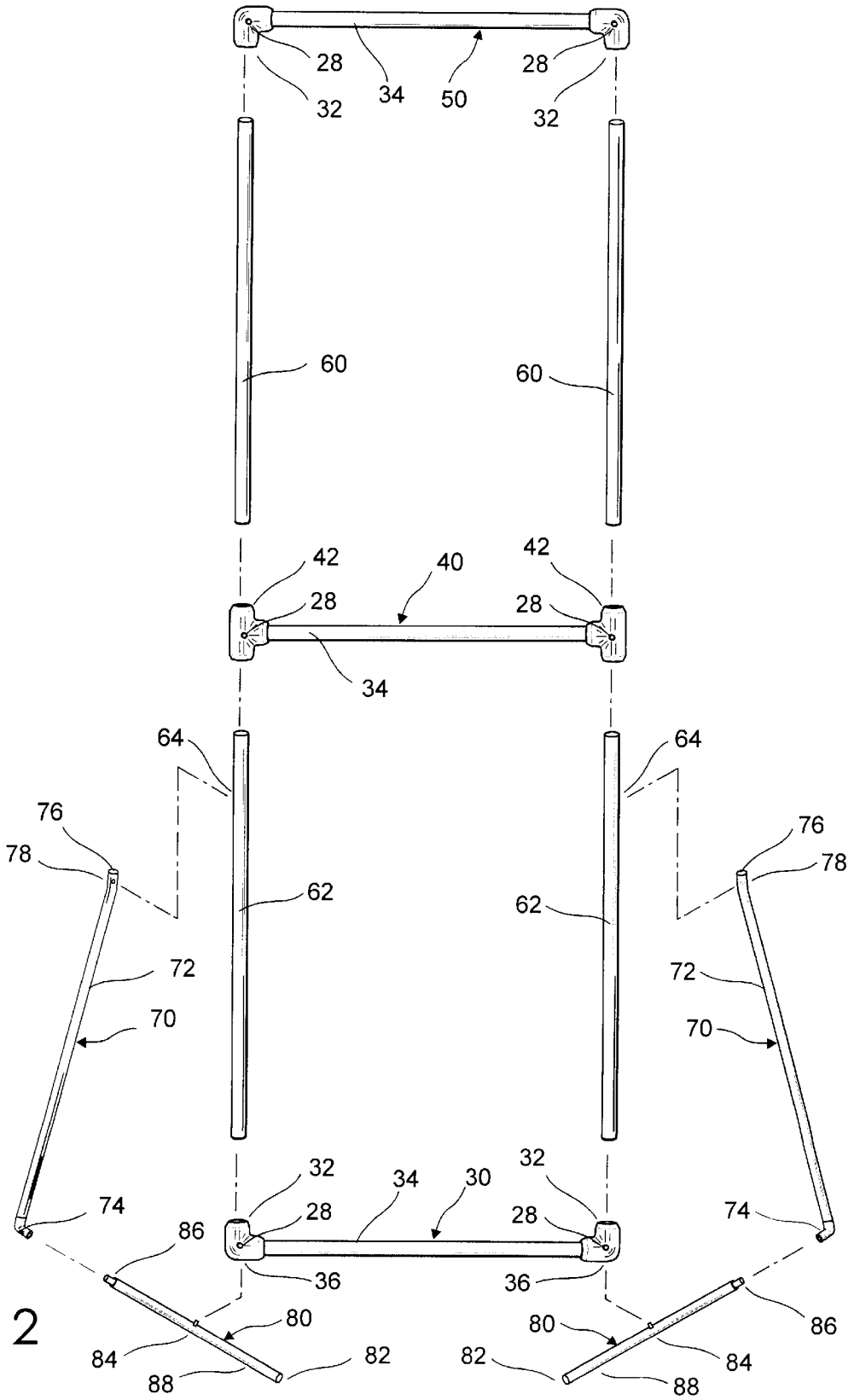
FIG. 2 shows an exploded view of an individual display-stand frame.

A typical embodiment of the individual, free-standing, portable, modular display stand of my invention is shown in FIG. 1. FIG. 2 shows an exploded view of an individual display-stand frame. In the preferred embodiment, specified frame members are made out of light-weight, thin-wall, black-colored PVC pipe and black-colored PVC pipe-connecting fittings. The PVC pipe size is preferably what the industry refers to as 1-inch-schedule, which is substantially 1.315 inch outside-diameter pipe. The PVC pipe preferable has a substantially 0.05 inch wall thickness. The PVC fittings are also referred to by the industry as 1-inch-schedule PVC fittings, and are sized to accept the 1-inch-schedule PVC pipe. It should be noted that any number of pipe and fitting diameters, and pipe wall-thicknesses may be used for the frame members. Standard colored-PVC pipe and colored-PVC fittings are available from a variety of manufacturers, such as Engineered Plastics, Inc. of St. Augustine, Fla. Custom color, diameter, and wall-thicknesses of pipe may be extruded by a variety of plastic-extruding companies. It should also be noted that the tubular structure frame could also be made of other types of plastic pipe, or metal pipe—for example, aluminum pipe—and could be made in any number of sizes and colors.

Figure 3:
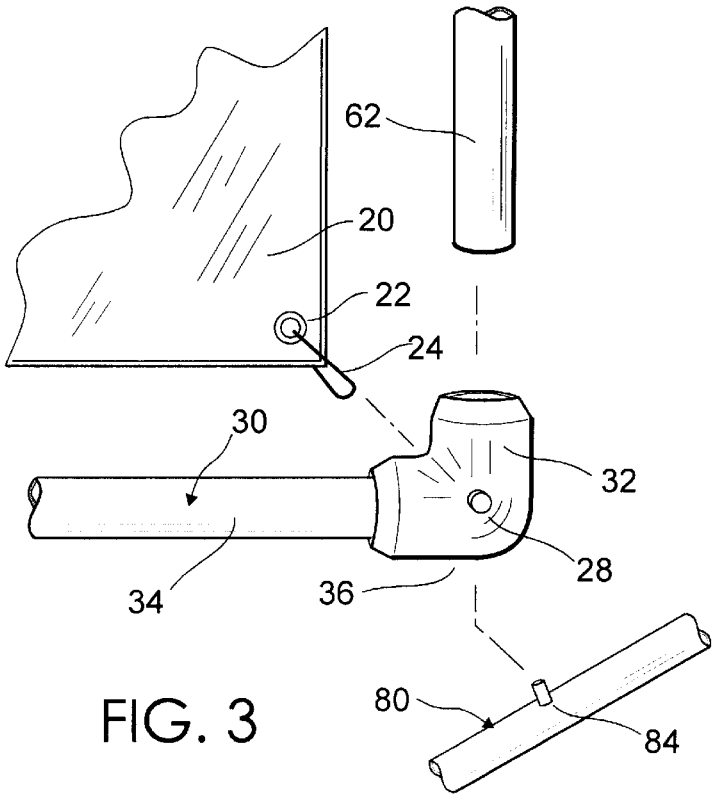
FIG. 3 shows an exploded view of the respective noted portion of FIG. 1.

As shown in FIG. 2, a bottom crossbar 30 is comprised of two 1-inch-schedule PVC elbow-sped fittings 32 that are adhesively joined and/or fastened with a screw to a horizontal 1-inch-schedule PVC pipe 34. These two fittings 32 have holes 36 (not visible on drawing) in their bottom surfaces to receive a pin 84 on a foot assembly 80. These two fittings 32 also either have holes in their front surfaces or have pegs 28 on their front surface for attaching a graphic panel 20 to the display frame as shown in FIGS. 1 and 3. A middle crossbar 40 is of similar construction to bottom crossbar 30, but utilizes two 1-inch-schedule PVC tee-shaped fittings 42. A top crossbar 50 is of similar construction to bottom crossbar 30, but does not require holes 36 for attaching feet 80. It is possible to make bottom crossbar 30 and top crossbar 50 identical so that they may be used interchangeably.

Two upper vertical PVC-pipe uprights 60 are appropriate lengths of the above described 1-inch-schedule PVC pipe. Two lower vertical PVC-pipe uprights 62 are similar to upper uprights 60, but have a threaded hole 64 (not visible on drawing) for screwing on two strut assemblies 70. As the PVC pipe used for lower uprights 62 is thin-walled, it is necessary to install and adhesively bond a PVC cylindrical plug on the inside of lower upright 62, so that it can then be drilled and threaded. In the preferred embodiment, a hole is drilled into lower upright 62 and plug, and a Heli-Coil® thread-insert is installed to create threaded hole 64.

Feet 80 are preferably made from an appropriate length of 1 inch diameter aluminum pipe 88, which is more rigid that PVC pipe and better resists bending and thus better supports the display stand. Aluminum pipe 88 may be painted, powder-coated, or anodized to match the color of the PVC frame members. This aluminum pipe 88 may have a plug or cap 82 installed to close its front opening so as to improve its aesthetic appearance. This aluminum pipe 88 has pin 84 installed mid-length that can be inserted in hole 36 in bottom crossbar 30 when the display frame is assembled. Pin 84 may be a ¼ inch diameter steel dowel pin. Hole 36 should have a substantially similar diameter as to create a light press-fit when pin 84 is inserted. As aluminum pipe 88 used for foot 80 is hollow, it is necessary to install a cylindrical plug inside of it before drilling a hole and then permanently pressing in pin 84. The cylindrical plug provides improved support for retaining pin 84 in aluminum pipe 88. The back end of aluminum pipe 88 has a plug-shaped connector 86 permanently installed in it that extends out preferably about ½ inch, and that has an appropriate extending diameter to fit into a ½-inch-schedule PVC elbow-shaped fitting 74.

Two struts 70 are preferably made from an appropriate length of ½-inch-schedule PVC black-colored pipe 72, which has a substantially 0.84 inch outside-diameter. This pipe 72 may have curves formed in it by heating it, bending it, and then cooling it. The bottom end of pipe 72 has ½-inch-schedule PVC elbow-shaped fitting 74 adhesively joined to it, that receives plug-shaped connector 86 when the frame is assembled. Pipe 72 may have a plug or cap 76 installed to close its top end opening so as to improve its aesthetic appearance. Pipe 72 has a through-hole 78 substantially near its top end. A thumbscrew (not shown) may be inserted in hole 78 passing through support 70, thus allowing strut 70 to be screwed to lower upright 62 when the display frame is assembled.

In all cases where a cylindrical frame member is to be inserted into a matching cylindrical orifice when the display frame is being assembled by the exhibitor (such as inserting lower upright 62 into fitting 32 of bottom crossbar 30), the two diameters should be substantially the same and sized so as to create a static light press-fit. This light press-fit should be sufficient to adequately hold the frame members together while still allowing for their easy assembly and disassembly.

Graphic panel 20 for the individual display stand as shown in FIG. 1 is made by printing graphical images on suitable paper or other material with a wide-format printer such as the NovaJet® injet printer from the Encad company of San Diego, Calif. or the DesignJet® inkjet plotter from the Hewlett-Packard company of Palo Alto, Calif. If suitable paper is used for printing on, the printed paper is then preferably laminated between plastic film to protect the printed graphics and to provide resulting graphic panel 20 with more rigidity, yet retain its ability to be rolled up for transportation and storage. The lamination can be done with either a hot or heat-activated laminating machine, or a cold laminating machine. A variety of plastic laminating films (such as matte, gloss, and luster) and a variety of film thicknesses may be used. It is not absolutely necessary to laminate the printed paper when making graphic panel 20, though lamination provides the advantages described above.

As best shown in FIG. 3, graphic panel 20 has eyelets or grommets 22 installed in each of its four comers, which allows it to be hung on the display frame with either small bands 24, hooks, or other suitable attachment means. If bands 24 are attached to grommets 22, bands 24 may then be hung on pegs 28. It is preferable that bands 24 be made of a substantially-non-stretching string or chain for the upper panel comers, and of a substantially-elastic string material for the lower panel comers. If hooks are attached to grommets 22, these hooks may then be attached to holes in fittings 32 and 42 (holes are not shown on drawings, but would replace pegs 28 in same location). Pegs 28 may be created simply by drilling an appropriate diameter hole in fittings 32 and 42, and partially pressing in a ¼-inch-diameter dowel pin. It is further advantageous that peg 28 have a means of preventing band 24 from accidentally slipping off of it. This may be readily accomplished by machining a groove (not shown) in the dowel pin, or by pressing a tapered cap (not shown) on over the dowel pin.

A preferred overall design height for the assembled individual display stand as shown in FIG. 1 is about 7 to 8 feet tall. The top of the display stand (and potentially the exhibiting company's name at the top of the graphic panel) is preferably sufficiently above an average-height person's head level as to stand out in a crowded room. One must however balance the benefits of a taller display (and thus longer frame uprights 60 and 62) with the ease of assembling the display (such as being able to reach to attach the top of graphic panel 20 to the top of the display frame) and the ease of transporting the disassembled display.

The preferred design width for the assembled individual display stand as shown in FIG. 1 is determined by the best width for graphic panel 20, which is determined by the width of the graphics printer and the laminator used to make graphic panel 20. A preferred graphic-panel width is about 34 inches, which makes good use of a 36-inch-wide graphics printer, and thus a resulting preferred assembled individual display-frame width is about 36 inches. There are wider graphics printers now available, but the benefits of a significantly wider panel must be balanced against the ease of handling graphic panel 20, the ease of transporting the disassembled display, and the cost of the necessary size graphics printer and laminator.

Figure 4:
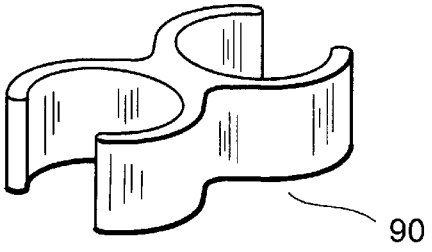
FIG. 4 shows a single-piece, snap-on frame connector.

FIG. 4 shows a preferred embodiment of a single-piece, snap-on display-frame connector 90. It is a single-piece of material, preferably a resilient plastic such as Nylon. It may be molded in the shape shown, or may be extruded in the profile shown and cut to the appropriate length. It has two substantially C-shaped recesses in a back-to-back configuration, that are substantially the same diameter as uprights 60 and 62. Frame connector 90 may be laterally snapped-on to uprights 60 and 62, and should sufficiently grip uprights 60 and 62 as to hold them in place, but still be capable of being forced to pivot around and move up or down on uprights 60 and 62 for positioning purposes. The height of frame connector 90 is substantially less than that of uprights 60 and 62. The height of frame connector 90 will influence the amount of gripping force it exerts, as well as the force required to attach and remove it. The outside profile of frame connector 90 may be altered for aesthetic tastes, as long as frame connector 90 still meets the functional requirements as just described.

Frame connector 90 has the advantages of being inexpensive, being virtually unbreakable, being simple to use, requiring no tools or small screws to attach it, and being simply and easily installed and removed. Further, frame connector 90 allows the individual display stands to be easily and quickly joined together in multiple configurations.

Figure 8:
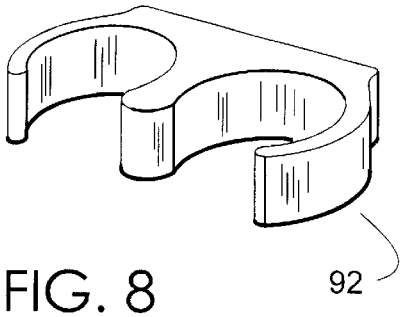
FIG. 8 shows an E-shaped, single-piece, snap-on frame connector.

FIG. 8 shows another embodiment of a single-piece, snap-on display-frame connector. Frame connector 92 is similar to frame connector 90, is made of the same material and in the same method, serves the same purpose, but is different in that it has a different shape. In frame connector 92, the two C-shaped recesses are oriented side-by-side, giving it a substantially E-shape.

Figure 9:
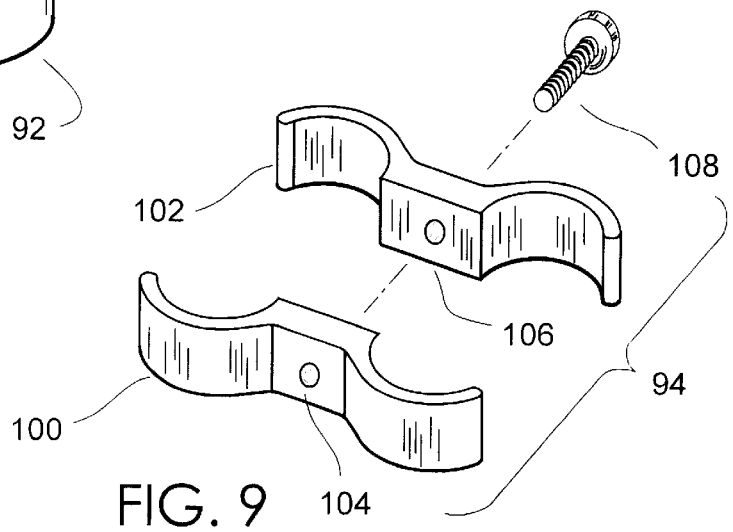
FIG. 9 shows a multiple-piece, clamping frame connector.

FIG. 9 shows an embodiment of a multiple-piece, clamping display-frame connector. Frame connector 94 serves the same purpose as snap-on frame connector 90, and has the additional advantage of providing an easily adjustable and, when necessary, greater gripping force. As shown in FIG. 9, frame connector 94 is comprised of two substantially matching-shape clamp brackets 100 and 102 that are made of the same material and in the same manner as frame connector 90, and that when screwed together with thumbscrew 108 create two gripping recesses for holding uprights 60 and 62. Bracket 102 has a through hole 106 that allows for thumbscrew 108 to pass through. Bracket 100 has a threaded hole 104 that receives thumbscrew 108. Frame connector 94 may be further designed with a guide pin (not shown) that is permanently installed in bracket 100 and passes through a clearance hole (not shown) in bracket 102 that runs parallel to thumbscrew 108. This guide pin (not shown) would still allow brackets 100 and 102 to move in and out from each other, and would also prevent them from rotating around thumbscrew 108 relative to each other.

Figure 10:
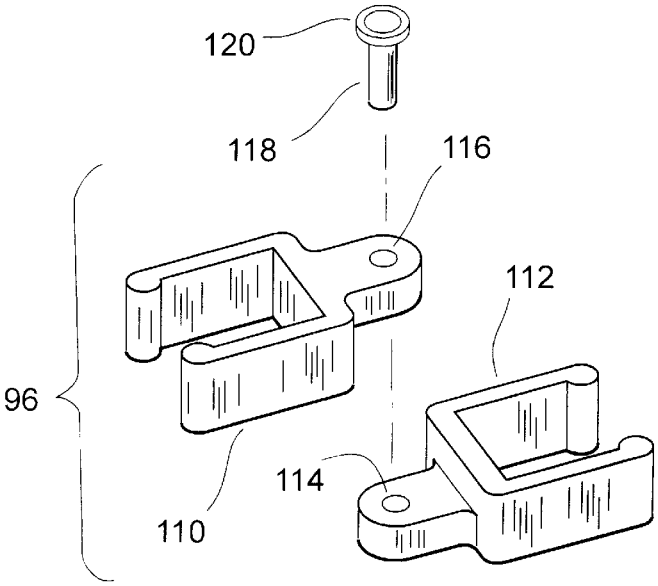
FIG. 10 shows a multiple-piece, internally-hinged, snap-on frame connector that can be used for pivotably connecting non-circular display frame uprights.

FIG. 10 shows an embodiment of a multiple-piece, internally-hinged display-frame connector that may be used for connecting frames designed with uprights 60 and 62 that are non-cylindrical in cross-section. Frame connector 96 serves the same purpose as snap-on frame connector 90. As shown in the exploded view in FIG. 10, frame connector 96 is comprised of two substantially-matching-shape snap-on brackets 110 and 112 that are made of the same material and in the same manner as frame connector 90. Brackets 110 and 112 have a snap-on recess profile that substantially matches the cross-section profile of the non-cylindrical upright. The snap-on profile shown in FIG. 10 is intended for a substantially-rectangular-cross-section upright. Many other profiles, such as octagonal, may be utilized. Bracket 110 has a slip-fit through hole 116 that allows for a rivet or hinge-pin 118 with a retaining flange head 120 to pass through. Bracket 112 has a press-fit through hole 114 that receives hinge-pin 118. When permanently assembled, hinge-pin 118 holds brackets 110 and 112 together, while allowing them to pivot relative to each other around the axis of hinge-pin 118.

Operation

The display stand of my invention has the important advantage of being able to be assembled by an exhibitor quickly and without tools. The frame-assembly process is best described by referring to the exploded view of the display frame shown in FIG. 2. One should note that right side and left side frame members are identical, and are assembled in the same manner. Plug-shaped connector 86 of foot 80 is inserted into fitting 74 of strut 70. Pin 84 of foot 80 is inserted into hole 36 (not visible on drawing) in the bottom of fitting 32 of crossbar 30. Lower upright 62 is inserted into fitting 32 of bottom crossbar 30. A thumbscrew (not shown) is inserted through hole 78 of strut 70, and then screwed into threaded hole 64 (not visible on drawing) of lower upright 62, to hold strut 70 to lower upright 62. Fittings 42 of middle crossbar 40 are inserted over the top ends of lower uprights 62. Upper upright 60 is inserted into fitting 42 of middle crossbar 40. Fittings 32 of top crossbar 50 are inserted over the top ends of upper uprights 60.

Graphic panel 20 is suspended from the assembled frame as best shown in FIG. 3 by looping bands 24 over pegs 28. Alternatively, graphic panel 20 may be suspended from the assembled frame by using hooks (not shown) attached to grommets 22. The hooks would then be attached to holes (not shown) that would be on the frame in place of pegs 28.

Figure 5:
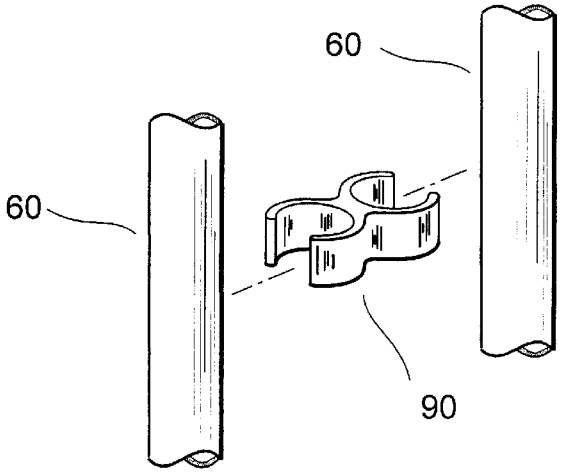
FIG. 5 shows an exploded view of a single-piece, snap-on frame connector connecting two display-frame uprights, as indicated on the respective noted portions of FIGS. 6 and 7.
Figure 6:
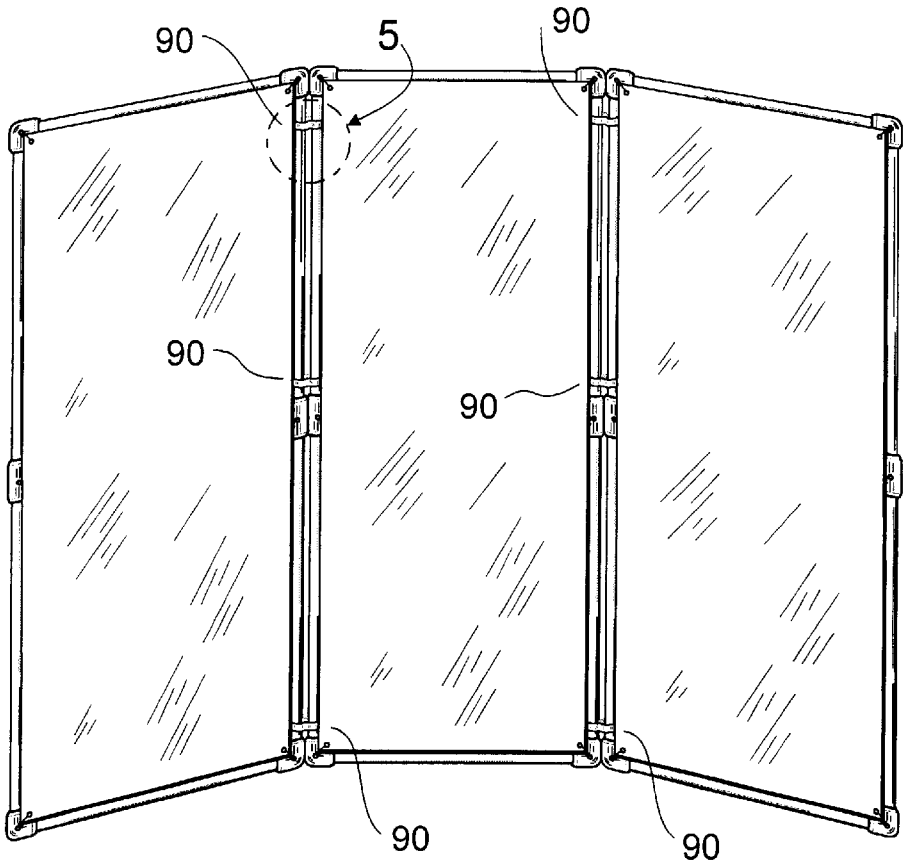
FIG. 6 shows three display stands connected in a substantially-curved-wall configuration.
Figure 7:
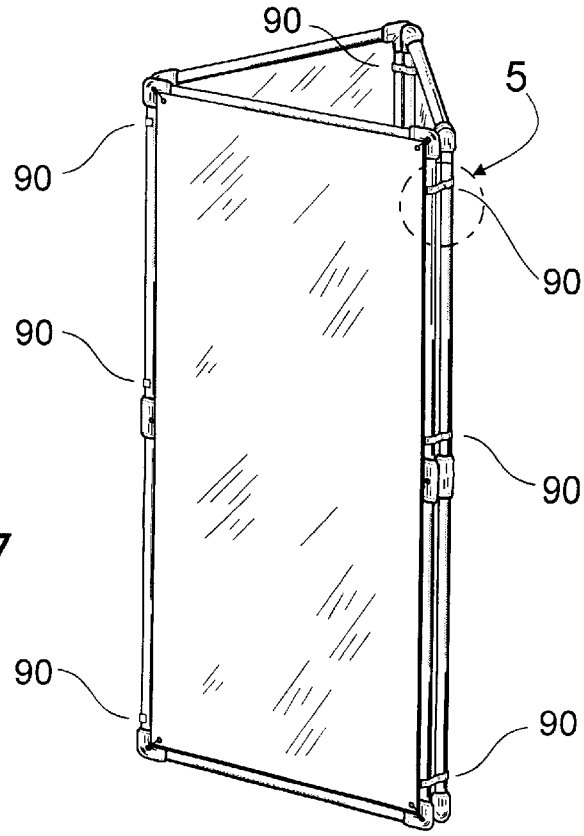
FIG. 7 shows three display stands connected in a triangular-tower configuration.

Multiple display stands may be connected in many configurations as illustrated in FIG. 6 showing three stands connected in a substantially-curved-wall configuration and in FIG. 7 showing three stands connected in a triangular-tower configuration. Other configurations are of course possible, and additional stands may be used. Frame connector 90 as shown in FIG. 4 is used to connect the individual display stands as illustrated in FIG. 5. Frame connector 90 is used by simply snapping it onto uprights 60 or 62. It may be forced to slide up or down upright 60 or 62 as required. It allows the individual display frames to be pivoted relative to each other. One may use two frame connectors 90 to connect two frames together, one being employed near the top of the displays and one near the bottom, or one may use an additional third frame connector 90 near the middle of the displays. This arrangement of three frame connectors 90 is shown in both FIGS. 6 and 7.

An advantage of connecting the individual display stands together is that when they are arranged angled relative to each other as exemplified in FIGS. 6 and 7, the overall structure becomes self-standing and the support mechanism of foot 80 and strut 70 becomes unnecessary. The support mechanism of foot 80 and strut 70 may of course still be used for additional stability.

Other type frame connectors may be used in place of frame connector 90. Frame connector 92 as shown in FIG. 8 is used in the same fashion as frame connector 90, that is, it is laterally snapped onto uprights 60 and 62.

Frame connector 94 as shown in FIG. 9 is used by first loosening thumbscrew 108 sufficiently to locate two uprights 60 or 62 in the two recesses, and then tightening thumbscrew 108 to clamp the two uprights together. As with frame connector 90, frame connector 94 also allows the two connected display frames to be angled relative to each other. Frame connector 94 has the additional advantage of providing an easily adjustable and, when necessary, greater gripping force.

Frame connector 96 as shown in FIG. 10 is used to connect two display frames together while retaining the ability to angle the frames relative to each other when uprights 60 and 62 are not cylindrical in shape. Frame connector 96 is also snapped laterally onto uprights 60 and 62.

The display system described in my invention is easily and compactly packed for transportation and/or storage. A single display stand as shown in FIG. 1 may be disassembled and packed into a substantially-cylindrical carrying case (not shown) that has a removable lid on one end. One first rolls up graphic panel 20 and inserts it in the case. One then lets graphic panel 20 unfurl until it fits snugly against the inside of the case. The disassembled frame members may then be placed into the case. It is advantageous to insert a protective sheet (not shown) into the case after inserting graphic panel 20 and before inserting the frame members, so as to protect graphic panel 20 from damage. The necessary length for this carrying case is determined by the longest frame member.

A larger-diameter, substantially-cylindrical carrying case (not shown) may be used to hold, transport, and store multiple display stands, where, as described above, graphic panels 20 are first rolled and inserted, and then the disassembled frame members are inserted.

Having multiple sizes of carrying cases allows an exhibitor more flexibility. With two cases sized to hold single display stands and one case sized to hold three stands, an exhibitor could choose to send individual stands to two different locations, or take three stands to one location to erect a larger display wall.

SUMMARY RAMIFICATIONS, AND SCOPE

Accordingly, one will see that the portable, modular, graphics-display system of my invention provides a truly modular, versatile, portable display system with many advantages over existing art. One may chose to use the individual free-standing display stands in different locations at one exhibit or at multiple simultaneous exhibit sites. Alternatively, one may chose to connect the individual display stands together in various configurations and thus create a larger overall structure. This larger structure may become freestanding without need for the individual stand supports. The frame connectors described in my invention are simple to use. Further, the frame connectors may be easily removed, such that an individual free-standing display stand appears as a complete display, not a cannibalized section of a larger display. As the system is modular, one may purchase stands individually, and upgrade as necessary. It is easy and economical to change the graphics on only one panel of a three-panel display, thereby effectively changing the message of the entire display. In addition, the display system is light-weight, easy to use, and easy to transport when packed.

Although the description above contains many specificities, these should not be construed as limiting the scope of the invention but as merely providing illustrations of some of the presently preferred embodiments of this invention. For example, when assembling the individual display frame, one might choose to leave out middle crossbar 40 and upper uprights 60, effectively creating a "half-height" tall or "table-top" display that would have a "half-length" graphic panel attached to it. Similarly one might assemble the entire individual display-stand frame, and then attach the "half-lengh" graphic panel to top crossbar 50 and middle crossbar 40, leaving the bottom half of the display stand open.

Further, the individual display frame could be made without middle crossbar 40, but instead with upper upright 60 plugging directly into lower upright 62. Further, both uprights 60 and 62 might be replaced with a single, telescoping upright assembly, allowing the overall display height to be varied.

In addition, one might chose to use my invention for other applications, such as for office or workplace partition walls, or for a portable privacy screen.

Thus the scope of the invention should be determined by the appended claims and their legal equivalents, rather than by the examples given.

I claim:

1. A display system comprising a plurality of display stands and display-stand connectors;

a) where said display stand comprises a frame and at least one panel;

b) where said frame has at least one left and at least one right upright;

c) where said frame has a removable L-shaped support structure that when attached makes said frame free-standing said L-shaped support structure is attached to one of said upright and a bottom of said frame;

d) where said at least one panel is attachable to said frame for viewing;

e) where said at least one panel is capable of being rolled up for transportation and storage;

f) where said display-stand connectors are attachable to said at least one upright, and when attached, will securely hold said at least one upright of one said frame juxtaposed to said at least one upright of a second said frame, and will allow thus connected uprights to be rotated about a vertical axis relative to each other, thereby allowing said frames to be arranged and held together angled relative to each other;

g) where said display-stand connector can be repeatedly attached to and completely removed from said frame, h) whereby, said display stand is capable of being used independently when said removable support structure is attached;

i) whereby, a larger display can be created by connecting a plurality of said display stands together with said display stand connectors; and j) whereby, a larger display created by connecting a plurality of said display stands together with said display stands being arranged angled relative to each other becomes free-standing without need for said removable support structures.

2. The display system of claim 1, wherein said display-stand connector is attachable to said frame after said frame is completely assembled and without disassembling said frame.

3. The display system of claim 1, wherein said display-stand connector is attachable to said frame without the use of tools.

4. The display system of claim 1, wherein said display-stand connector is at least partially comprised of a resilient material and has two recesses each having a profile that is sufficient to be laterally snapped onto said at least one upright and that further sufficiently grips two said at least one uprights so as to hold them in juxtaposition.

5. The display system of claim 4, wherein said display-stand connector has an integral, one-piece body.

6. The display system of claim 4, wherein said two recesses are C-shaped profiles each sufficient to be snapped onto a cylindrical upright, and said two C-shaped profiles are arranged in a back-to-back configuration.

7. The display system of claim 4, wherein said two recesses are C-shaped profiles each sufficient to be snapped onto a cylindrical upright, and said two C-shaped profiles are arranged in a side-by-side configuration.

8. The display system of claim 4, wherein said display-stand connector is hinged, allowing said two recesses to be rotated relative to each other.

9. The display system of claim 1, wherein said display-stand connector is comprised of two brackets that when affixed together create two recesses each of a profile that is sufficient to clamp around said at least one upright, and is further sufficient to grip two said at least one uprights so as to hold them in juxtaposition.

10. The display system of claim 9, wherein said display-stand connector contains means for adjusting the clamping force exerted on said at least one upright by said brackets.

11. A frame for use in a display system, said display system comprising a plurality of display stands and display-stand connectors;

a) where said display stand comprises said frame and at least one panel;

b) where said frame has at least one left and at least one right upright;

c) where said frame has a removable L-shaped support structure that when attached makes said frame free-standing said L-shaped support structure is attached to one of said upright and a bottom of said frame;

d) where said at least one panel is attachable to said frame for viewing;

e) where said at least one panel is capable of being rolled up for transportation and storage;

f) where said display-stand connectors are attachable to said at least one upright, and when attached, will securely hold said at least one upright of one said frame juxtaposed to said at least one upright of a second said frame, and will allow thus connected uprights to be rotated about a vertical axis relative to each other, thereby allowing said frames to be arranged and held together angled relative to each other;

g) where said display-stand connector can be repeatedly attached to and completely removed from said frame, h) whereby, said display stand is capable of being used independently when said removable support structure is attached;

i) whereby, a larger display can be created by connecting a plurality of said display stands together with said display stand connectors; and j) whereby, a larger display created by connecting a plurality of said display stands together with said display stands being arranged angled relative to each other becomes free-standing without need for said removable support structures.

* * * * *